US006981887B1

(12) United States Patent
Mese et al.

(10) Patent No.: US 6,981,887 B1
(45) Date of Patent: Jan. 3, 2006

(54) UNIVERSAL FIT USB CONNECTOR

(75) Inventors: John C. Mese, Cary, NC (US); Nathan J. Peterson, Raleigh, NC (US); Rod D. Waltermann, Durham, NC (US); Arnold S. Weksler, Raleigh, NC (US)

(73) Assignee: Lenovo (Singapore) Pte. Ltd., (SG)

( * ) Notice: Subject to any disclaimer, the term of this patent is extended or adjusted under 35 U.S.C. 154(b) by 0 days.

(21) Appl. No.: 10/926,492

(22) Filed: Aug. 26, 2004

(51) Int. Cl.
*H01R 27/00* (2006.01)

(52) U.S. Cl. ..... 439/244; 439/660

(58) Field of Classification Search ..... 439/224, 439/660, 218, 295, 221
See application file for complete search history.

(56) References Cited

U.S. PATENT DOCUMENTS

| | | | | |
|---|---|---|---|---|
| 5,442,243 | A * | 8/1995 | Bailey | 307/10.5 |
| 5,716,225 | A * | 2/1998 | Stringer et al. | 439/221 |
| 5,784,511 | A | 7/1998 | Kikuchi et al. | 385/57 |
| 6,036,549 | A * | 3/2000 | Wulff | 439/660 |
| 6,156,199 | A | 12/2000 | Zuk, Jr. | 210/321.84 |
| 6,373,643 | B1 | 4/2002 | Chen | 359/804 |
| 6,424,525 | B1 | 7/2002 | MacLeod et al. | 361/686 |
| 2004/0242075 | A1 * | 12/2004 | Tago et al. | 439/660 |
| 2004/0259536 | A1 * | 12/2004 | Keskar et al. | 455/418 |
| 2005/0042930 | A1 * | 2/2005 | Harkabi et al. | 439/660 |

* cited by examiner

*Primary Examiner*—P. Austin Bradley
*Assistant Examiner*—Phuongchi Nguyen
(74) *Attorney, Agent, or Firm*—James A. Lucas; Driggs, Lucas, Brubaker & Hogg Co., LPA

(57) ABSTRACT

Peripheral devices are connected to the receptacle of a central processing unit (CPU) or to a hub using an "A" type universal serial bus (USB) connector plug and receptacle that ensures a positive connection regardless of the relative orientation of the two components. This is achieved mechanically, electronically, or through a combination of both. In one embodiment, the receptacle includes a bidirectional backplane that permits electrical contacts within the receptacle to slide or move in a direction that is perpendicular to the linear direction of the connector and its connecting cables. Another option is to use an orientation sensor such as a pressure transducer which serves to detect the orientation of the plug with respect to the receptacle. Another feature is the use of a multi-layer printed circuit board to cross or reverse the pins in the plug, such as D+ to D− and Power to Ground.

15 Claims, 7 Drawing Sheets

(a)

(b)

Side View

(a)

Top View (b)

Side View

(a)

Top View

(b)

(a)

(b)

Side View (a)

Front View (b)

UNIVERSAL FIT USB CONNECTOR

FIELD OF THE INVENTION

The present invention relates to connectors that are used to couple peripheral devices to a central processing unit (CPU), such as a server or a personal computer. More specifically, it relates to a universal serial bus (USB) connector that provides a connection between peripherals and either the CPU or a hub connected to the CPU.

BACKGROUND OF THE INVENTION

The capabilities of a computer are maximized by utilizing a variety of external peripheral devices that are connected to the computer. This may involve any number of peripherals, such as scanners, printers, digital speakers, modems, compact disk drives, radio frequency device transceivers, video/audio links, MP3 players, hard drives, DVD drives, CD drives, smart card/bar code readers, digital cameras, digital video recorders and speaker amplifiers. One USB port can be used to connect over 100 peripheral devices. The computer can be a personal computer, laptop computer, handheld computer, work station, server or the like.

A USB connector replaces different kinds of serial and parallel port connectors with a standardized plug and port connection. For the successful utilization of a USB connector, the CPU must have an operating system that is USB compliant and that understands it. This permits hot swapping to be done without the need to shut down and reboot the system each time a peripheral device is attached or removed from the CPU. The CPU automatically detects the peripheral device and configures the necessary software. The USB allows several peripheral devices to be connected at the same time. Many CPUs have more than one USB port, and some peripheral devices called USB hubs have additional ports to allow several peripherals to be cascaded or "daisy chained" together. The USB senses that a peripheral requires power and delivers the power to the peripheral. USB Implementers Forum (USB-IF) specifications use the term "USB" to refer to slower speeds of 12 Mbps and 1.5 Mbps for peripherals, such as joysticks, keyboards and mice, and the term "Hi-speed USB" for high speeds of 480 Mbps useful with most other devices, such as digital cameras and CD-ROM burners.

Two different types of USB connectors are in common use. One is a type "A" connector, and uses a receptacle that contains four pins in a straight line on one side of a connector plate. Pin #1 is for the signal and pin #4 is the ground connection while pins ##2 and 3 are for the output and input of data, respectively. Another is a type "B" connector, comprising two pins on either side of the receptacle connector plate. The present invention is principally concerned with an improvement in connectors of the "A" type.

One method of coupling the connector to the port of a computer or a hub is described in U.S. Pat. No. 5,784,511 wherein a magnetic connector and cable are employed for connecting peripherals to the computer through an infrared computer link. This requires that each unit have a transmitter and a receiver element which communicate through optical fibers without cables. The connector has a shaped surface that ensures correct alignment in the receiving connector slot or port.

U.S. Pat. No. 6,424,525 gives details of a device for connecting a plurality of peripherals to a computer, or to a hub which, in turn, interfaces with a computer. The device employs multiple bays, each of which includes separate data and power connections, a rail for alignment of a peripheral in the bay, a visual alignment element and an alignment pin.

The USB connector plugs of the prior art can only be successfully inserted into a USB port or receptacle one way. Visually, the orientation is not readily apparent unless viewed directly head-on into the USB connector. Typically, the ports are located on a rear panel of the CPU and are not always readily accessible. Additionally, the port locations may be obstructed or hard to view. Accordingly, one common approach is to provide a USB icon on the plugs to provide tactile feedback in an attempt to facilitate the obtaining of proper orientation.

A shortcoming of the prior art is the failure to provide a reliable mechanical coupling of a USB connector with a port of a central processing unit.

SUMMARY OF THE INVENTION

It is an object of the present invention to overcome the shortcomings of prior art USB connectors.

Another object is to provide a USB connector that can be plugged into a port without the need to visualize the connection process.

The present invention relates to a connector (also referred to as a plug) that can be coupled to a port (also referred to as a receptacle) independent of orientation. This is achieved by positioning the USB connector initially in the middle of the receptacle. When inserted into the USB receptacle, the plug is pushed along until the device is fully inserted and the pins are electrically connected to the contacts in the receptacle. A perpendicular backplane in the receptacle is bidirectional so that the USB connector plug can be inserted regardless of its orientation to the receptacle. The connector of the present invention is useful with a USB key, a USB hdd (hard disc drive), USB DVD/DVD and RW/CD/CDRW USB connectors, among others.

The invention also relates to a USB connection utilizing an orientation sensor, such as a pressure transducer, to sense the physical orientation of the connector plug with respect to the receptacle. The sensor typically is mounted on or within the receptacle where it is powered by the CPU. However, it is also possible to mount the transducer in the plug.

The invention further relates to a computer system including a central processing unit (CPU) and at least one peripheral device connected, either directly or through a hub, to the CPU using a universal serial bus (USB) connection. The connection comprises a plug and a receptacle, including an arrangement for bidirectional connection of the plug with the receptacle. The arrangement can be implemented in hardware or software or a combination thereof. A mechanical arrangement may use a floating contact and may be further implemented so that the contacts in the plug are switched to match the corresponding contacts in the receptacle. Alternatively, the USB connection may have an orientation sensor, such as a pressure transducer, micro switch or optical device to sense the orientation of the connector plug with respect to the receptacle.

The invention also relates to a method for using an "A" type USB connector to connect a peripheral device to a receptacle of a host that is either a hub or a CPU. The method comprises the first step of using a bidirectional connector or plug extending from the peripheral device to the receptacle of the host. This is followed by engaging the receptacle with the plug. Finally, the signals are matched through the plug in accordance with established protocol for the USB connector. Alternatively, the signals are matched by the CPU or by a printed circuit board, or by a combination of hardware and software. For example, the signals can be matched using signal switching.

The invention also relates to implementation of the invention in software or hardware, or a combination of both.

Further, the invention relates to an article of manufacture that comprises a computer usable medium having a computer readable program embodied in said medium. The computer readable program, when executed on a computer, causes the computer to implement the connection of an "A" type USB connector plug to a compatible receptacle by sensing the orientation of contacts of the plug with respect to the contacts of the receptacle, and matching the contacts with one another.

BRIEF SUMMARY OF THE DRAWING

The present invention will now be described with specific reference to the drawings which are provided for illustrative purposes only, and not as a limitation thereof.

FIG. 1(*b*) shows an end view of the receptacle of FIG. 1(*a*);

FIG. 1(*c*) shows an assembly of a plug and receptacle, partially in cross section;

FIG. 2(*b*) is a top detailed view of the receptacle of FIG. 2(*a*);

FIG. 3(*b*) is a top detail view of the receptacle of FIG. 2(*a*);

FIG. 4(*b*) shows the connection between the components wherein the plug is inverted with respect to the receptacle;

FIG. 5(*b*) is a frontal cross sectional view of the modification shown in FIG. 5(*a*);

DETAILED DESCRIPTION OF THE INVENTION

In more detail, the present invention describes a USB connector comprising a plug and a receptacle wherein the plug is capable of being inserted into the receptacle in either of the two normal planes of orientation. Although the discussion will be directed to a type "A" connector configured with four contacts in a plane, it is to be understood that the invention is not limited solely to that one configuration, but can be used with other pin arrangements, such as a five pin USB type mini-B connection as well.

Figure 1:
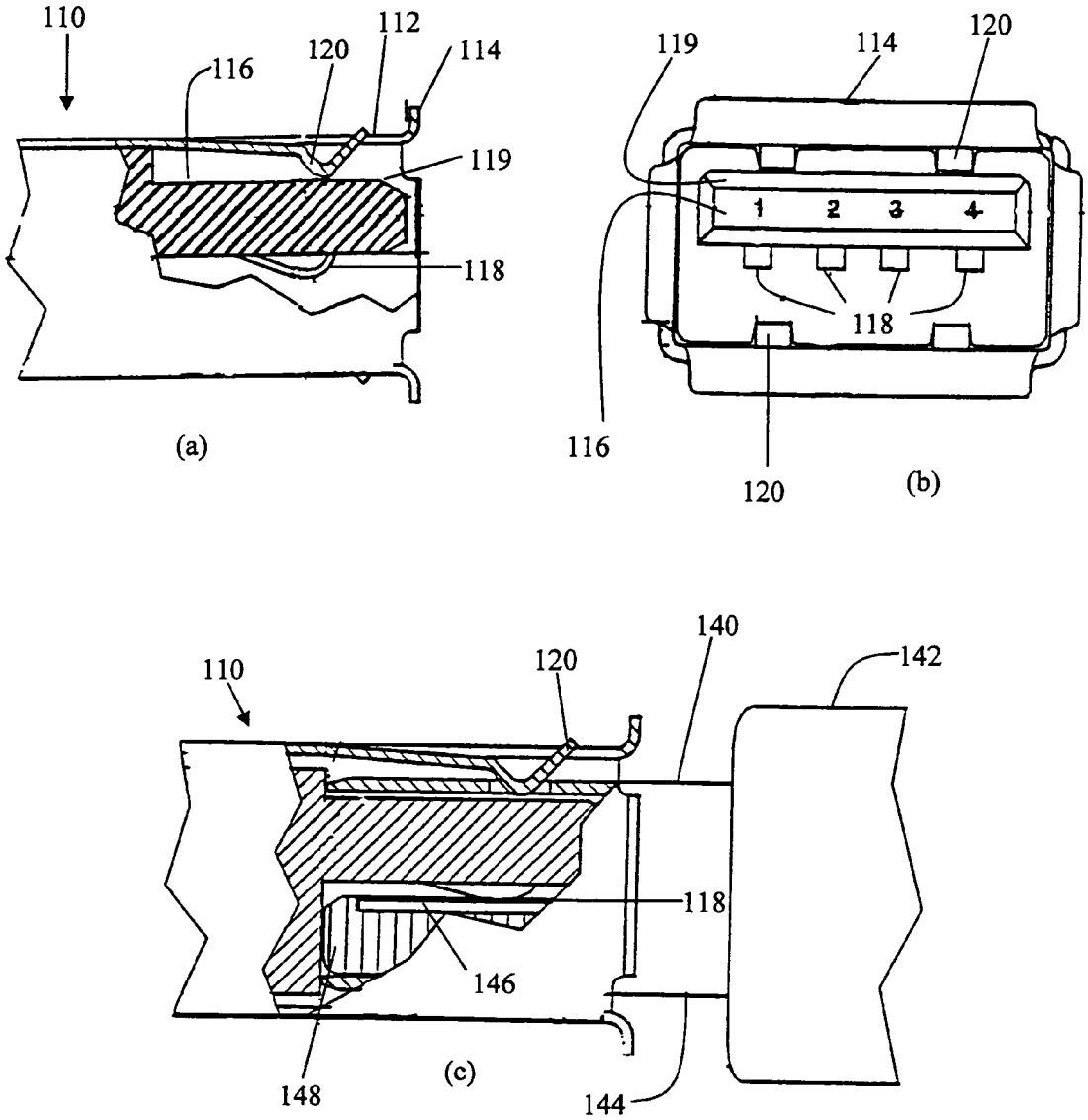
Figure 1 (Prior Art)
FIG. 1(*a*) shows a side view, partially in cross section, of a receptacle of a USB connector of the prior art.

Turning now to the drawings, FIGS. 1(*a*)–1(*c*) show a prior art USB device consisting of two components, a receptacle 110 and a connector or plug 140. FIG. 1(*a*) shows a side view of the receptacle 110, partially in cross section, and FIG. 1(*b*) shows the opening in the front of the receptacle. The receptacle 110 includes a housing 112 having a flange 114. Within the housing 112 is a contact holder 116 made from a suitable dielectric material. The free end of the holder 116 is beveled as shown or rounded to facilitate engagement with a corresponding plug. Attached to the holder 116 are contacts 118, numbered 1–4 in FIG. 1(*b*). Four spring latches 120 are shown in FIGS. 1(*a*) and 1(*b*), and are used to hold the plug in place as shown in FIG. 1(*c*). Here, the plug 140 is shown bonded in an overmold boot 142. The plug 140 includes an outer shield 144 surrounding a row of four pins, one of which is shown as 146 laminated on the surface of a pin holder 148 made from a suitable dielectric material. As with the free end of the contact holder 116, the free end of the pin holder 148 is likewise beveled or rounded to facilitate insertion into the receptacle 110. This rudimentary mating of the two beveled surfaces serves to provide the proper orientation of the connector 130 and the receptacle 110, but only if and when the two components of the connection are oriented correctly for engagement. It should be noted that each pin 146 electrically mates with one of the four contacts 118 in the receptacle 110. The plug 140 typically is joined by a shielded cable (not shown) to a suitable peripheral device (not shown). In like manner, the receptacle 110 is joined by cable (not shown) to a hub or CPU, such as a personal computer, laptop or a server (not shown).

Figure 2:
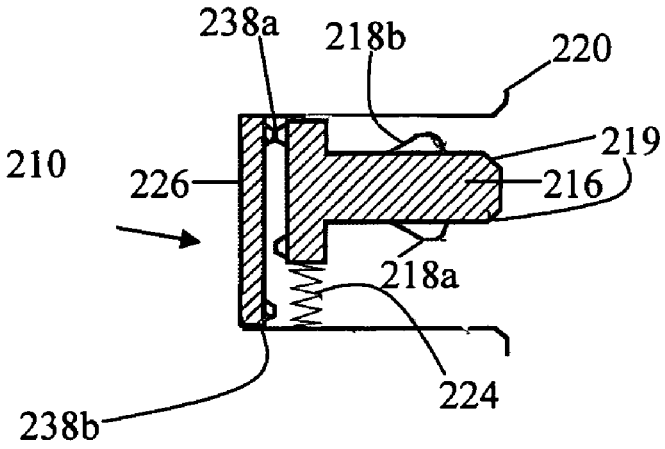
FIG. 2(*a*) shows a simplified cross sectional view of a receptacle of the present invention.
Figure 2:
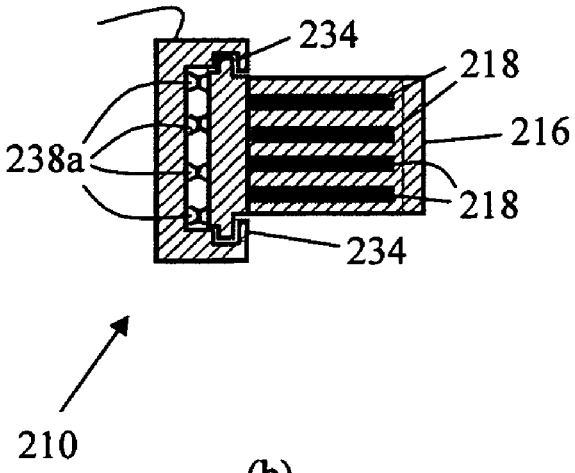

Turning now to the present invention, attention is directed to FIGS. 2(*a*) and 2(*b*) showing, respectively, the side and top of a receptacle 210 embodying features of the present invention. FIG. 2(*a*) shows a pair of latch clips 220 joined to back plate 226. The contact holder 216 has a row of contacts 218*a* on the lower surface of the holder 216 and a second row of contacts 218*b* on the upper surface. As viewed in FIG. 2(*b*), the contact holder 216 slides in a pair of glide tracks 234 molded or machined into the wall of the receptacle housing 212. This allows the holder 216 to move at right angles to the direction of the plug as it is being inserted into the receptacle. Bias means, such as spring 224, serves to bias the contact holder 216 against the top of the receptacle housing 212 when the plug is inserted in its normal manner, whereupon the normal contacts 218*a* engage the corresponding pins of the plug. This establishes an electrical connection between the receptacle and a row of contact pins 238*a* at the top of the contact holder 216. On the other hand, if the plug is inserted into the receptacle in the inverted position, it forces the contact holder downwardly against the spring 224, until a connection is established between the pins 238*b* at the bottom of the holder and the receptacle.

Figure 3:
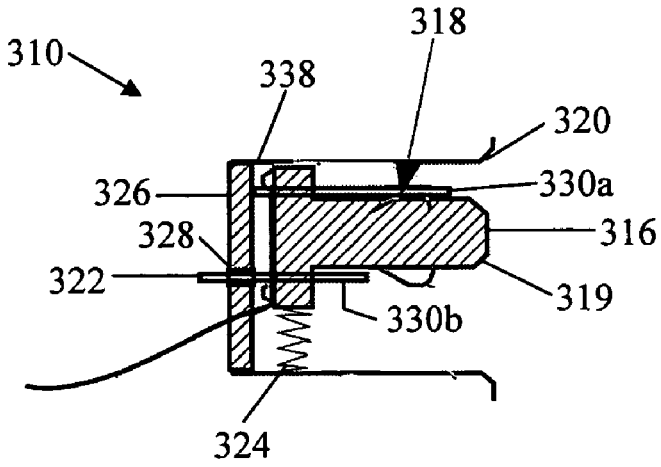
FIG. 3(*a*) shows a cross-sectional side view of a USB connector receptacle according to the present invention.
Figure 3:
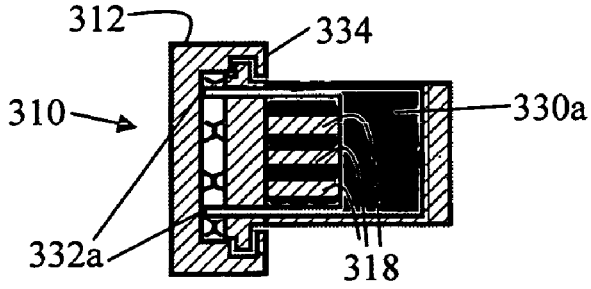
Figure 4:
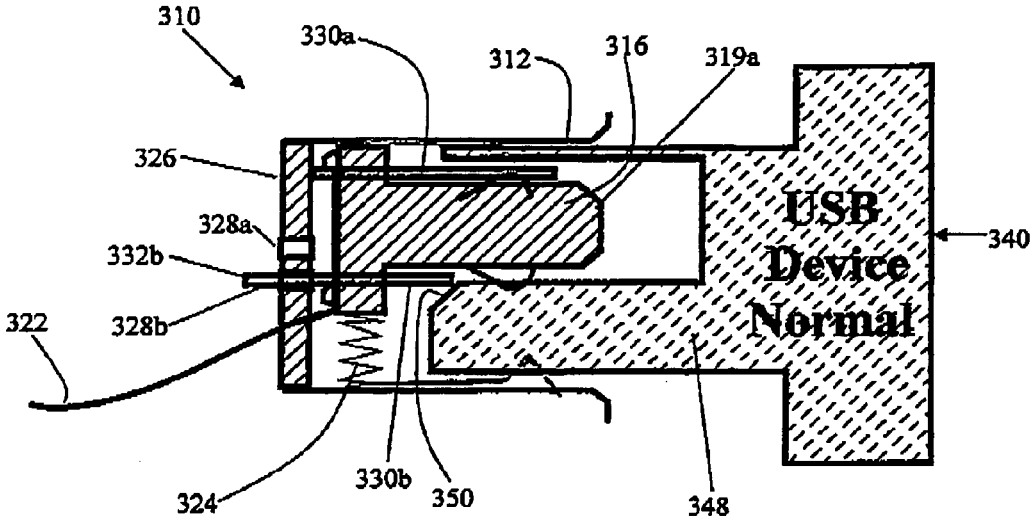
FIG. 4(*a*) shows the normal connection between the receptacle and the plug of FIG. 3.
Figure 4:
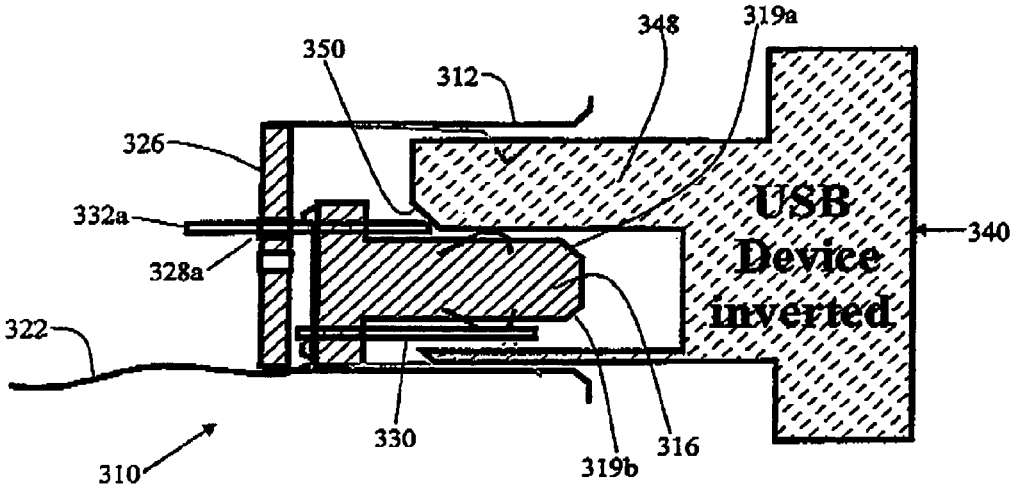

Next, attention is directed to FIGS. 3(*a*) and 3(*b*) and FIGS. 4(*a*) and 4(*b*) showing a variation of the receptacle of FIG. 2. The side view in FIG. 3(*a*) shows the two latch clips 320 including a back plate 326 having an aperture 328*a*. The holder 316 includes two beveled surfaces 319 on the leading edge. The contact holder includes an upper sliding shield 330*a* which includes a pair of pins 332*a*, and a lower sliding shield 330*b* which also has a pair of pins 332*b* seen in FIG. 3(*b*). Viewed from the top, the shields slide in a pair of glide tracks 334 molded or machined into the wall of the receptacle housing 312. The contact holder 316 is provided with means to move laterally, e.g. at right angles to the direction of insertion of the plug into the receptacle. Spring 324 serves to bias the contact holder 316 against the top of the receptacle housing 312.

The successful mating of the connector with the receptacle is shown in FIGS. 4(*a*) and 4(*b*) wherein the same numbers are used as in FIGS. 3(*a*) and 3(*b*) to refer to the same component parts. As with the prior art plug, this plug 340 is provided with an insulated pin holder 348 having a single beveled surface 350. This beveled surface contacts either of the beveled surfaces 318*a*, 318*b* of insulator 316 depending on the relative orientation of the two components. In FIG. 4(*a*), the plug is in the normal coupling position and biases the lower sliding shield 330*b* toward the back plate 326, thereby propelling the pins 332*b* through the lower aperture 328*b* in the back plate. On the other hand, FIG. 4(*b*) shows the plug oriented in the inverted or upside down position. As it is inserted into the receptacle 310, the beveled surface 350 of the pin holder 348 contacts upper beveled surface 319 on the contact holder 316 and biases the holder downwardly against the spring 324 until contact is made between one of the contacts 318 of the receptacle and one of the pins 346 of the plug. At the same time, the upper sliding shield 330*a* is pushed toward the back plate 326 causing pins 332*a* to engage and to slide into the upper apertures 328*a*.

Figure 5:
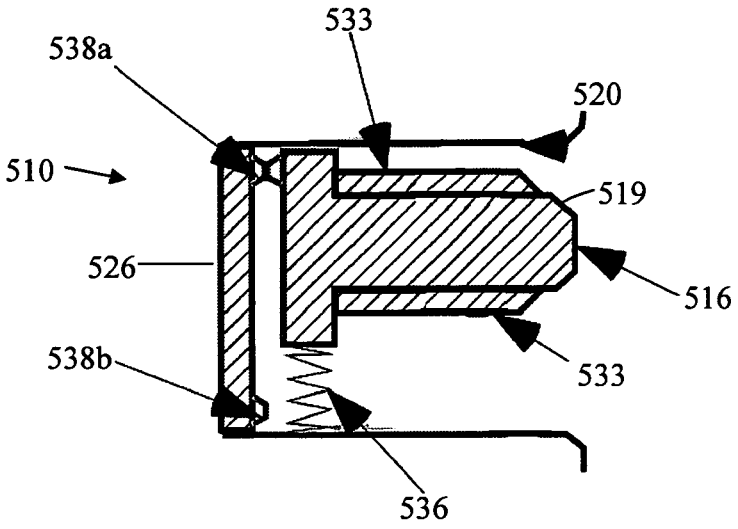
FIG. 5(*a*) is an elevation in cross section of a further modification of the present invention.
Figure 5:
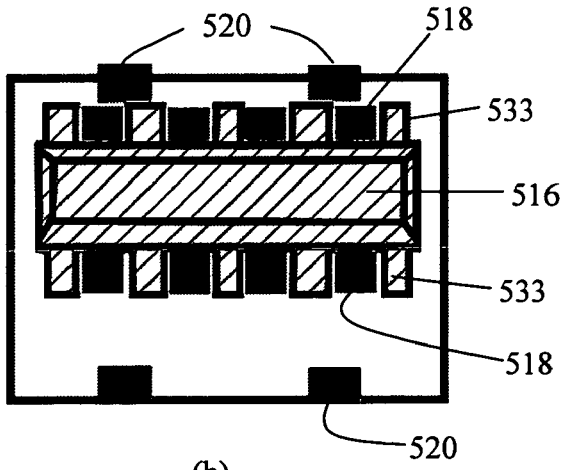

FIGS. 5(*a*) and 5(*b*) show yet another variation of the present invention in which the receptacle 510 uses a contact holder 516. Isolating ridges 533 are located along the contact holder 516 to prevent the contacts 518 from shorting against one another. The raised ridges 533 electrically isolate the individual contacts 518 from one another as a plug pushes the beveled edge 519 of the contact holder 516 downward against the spring 536 when the plug is in the inverted position. At the bottom of its movement, the contact holder 516 engages the lower contacts 538*b* on the back plane 526.

Figure 6:
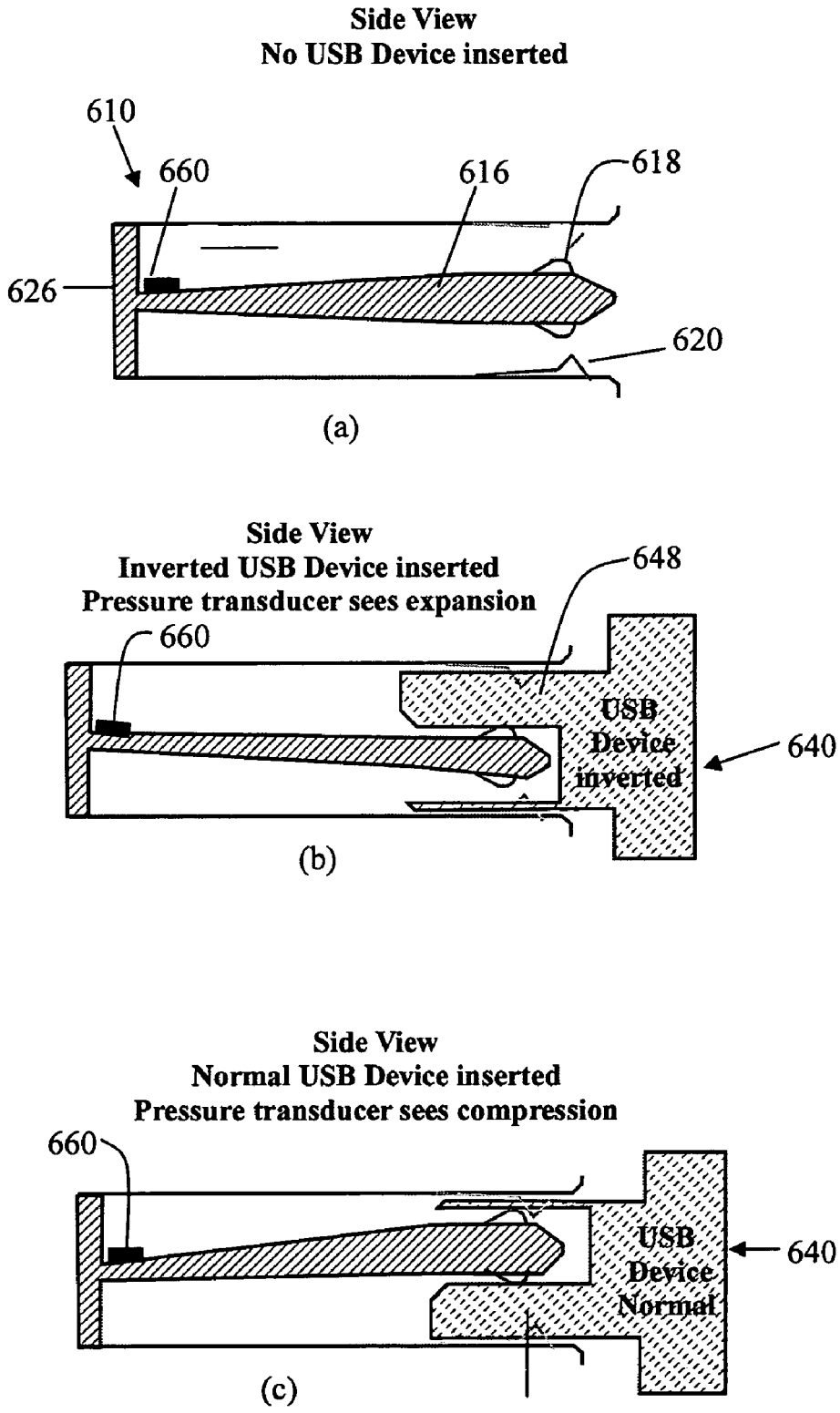
FIGS. 6(*a*), 6(*b*) and 6(*c*) show a variation in which an orientation sensor is used to determine the relative orientation of the component parts of the USB connector.

FIGS. 6(*a*), 6(*b*) and 6(*c*) show yet another embodiment of the invention in which an orientation sensor serves to determine the respective orientation of the components (plug and receptacle) of the USB device. In this example, a pressure transducer 660 is used as the sensor. The receptacle 610 is shown with the contact holder 616 joined to the back plate 626. The holder includes two sets each of four contacts 618. The transducer 660 is mounted so that it either sees compression as the plug 640 is inserted in the normal manner as shown in FIG. 6(*c*) or expansion as the plug is inserted in the inverted position as seen in FIG. 6(*b*). Based on the pressure on the transducer, a signal can then be transmitted to a motherboard or other device to make whatever adjustment may be needed in the circuitry so as to accommodate the orientation of the components of the connector.

Figure 7:
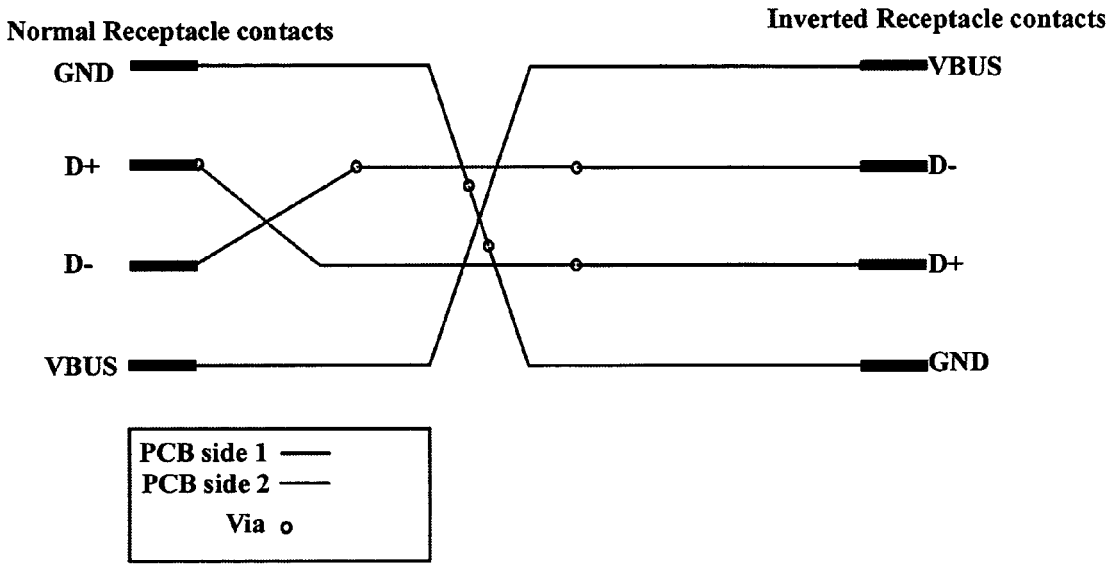
FIG. 7 is a simplified wiring diagram showing normal and inverted receptacle contacts.

The invention provides a mechanical implementation. It likewise applies to a reverse pin contact situation, such as D+ to D−, Pwr to Gnd, etc. Below are some of the means for reversing the pins to supply power and signal:

(A) Use a multi-layer printed circuit board to cross the pins over between the two sides. Use vias to conduct the signal between the layers. This wiring arrangement is shown schematically in FIG. 7.

(B) Install a pressure transducer or other type of orientation sensor to detect in which direction the mating surface is being forced, and use that signal to enable the connections for the mating side. This is shown in FIG. 6.

(C) Construct a USB connector with a sliding channel to allow the center section to move up and down. As the connector moves to one orientation, it will make contact with a set of pins to enable connection to the USB device.

(D) Use additional sets of conductors to route all eight contacts to the PCB, and sort it out on the mother board.

Figure 8:
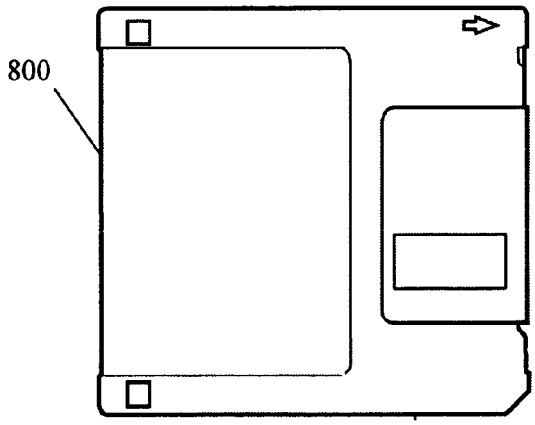
FIG. 8 shows a floppy disc, indicative of a computer-readable medium for carrying out the steps of the present invention.

FIG. 8 shows a computer-readable medium in the form of a floppy disc 800 for containing the software implementation of the program to carry out the various steps of project management according to the present invention. Other machine readable storage mediums are fixed hard drives, optical discs, magnetic tapes, semiconductor memories, such as read-only memories (ROMs), programmable read-only memories (PROMs), etc. The article containing this computer readable code is utilized by executing the code directly from the storage device, or by copying the code from one storage device to another storage device, or by transmitting the code on a network for remote execution. The computer program may be loaded into the memory to configure and to run the program herein described and claimed for execution. The computer program comprises instructions which, when read and executed by the system, perform the steps necessary to execute the steps or elements of the present invention.

The present invention meets all electrical, mechanical and environmental compliance standards for USB type "A" connectors. Among others, these include vibration, thermal shock, solderability, flammability, contact resistance and capacitance load. It also complies with EIA 364-13 that defines the maximum mechanical force required for inserting a USB connector and insertion force. A type "A" USB uses a plug or connector that is oriented upstream from the USB peripheral device toward the hub or CPU and a receptacle or receptacles that serve as the downstream output from the hub or the CPU.

The present invention can be realized in hardware, software, or a combination of the two. Any kind of computer system or other apparatus adapted for carrying out the methods described herein is suited. A typical combination of hardware and software could be a general purpose computer system that, when loaded and executed, controls the computer system such that it carries out the methods described herein. The present invention can also be embedded in a computer program product, which comprises all the features enabling the implementation of the methods described herein, and which, when loaded in a computer system, is able to carry out these methods.

Computer program instructions or a computer program in the present context mean any expression, in any language, code (i.e., pico code instructions) or notation, of a set of instructions intended to cause a system having an information processing capability to perform a particular function either directly or after either or both of the following occur: (a) conversion to another language, code or notation; (b) reproduction in a different material form.

While the invention has been described in combination with specific embodiments thereof, there are many alternatives, modifications, and variations that are likewise deemed to be within the scope thereof. Accordingly, the invention is intended to embrace all such alternatives, modifications and variations as fall within the spirit and scope of the appended claims.

What is claimed is:

1. A universal serial bus (USB) connector comprising a plug and a receptacle for use between a peripheral device and either a hub or a CPU, said connector utilizing an orientation sensor to sense the orientation of the plug with respect to the receptacle, said plug capable of being mechanically connected bidirectionally to the receptacle, said receptacle containing a contact holder having two rows of contacts, and the plug containing contact pins to engage one row of contacts in one of the contacts in one of the bidirectional orientations of the plug and the receptacle, and to engage the second row of contacts in the other bidirectional orientation.

2. The connection according to claim 1 wherein the orientation sensor comprises a pressure transducer that is mounted within the receptacle.

3. A universal serial bus connector for use between a peripheral device and either a hub or a CPU, said connector comprising a plug and a receptacle, said plug capable of being mechanically connected bidirectionally to the receptacle, said receptacle containing a contact holder having two rows of contacts, and the plug containing contact pins to engage one row of contacts in one of the bidirectional orientations of the plug and the receptacle, and to engage the second row of contacts in the other bidirectional orientation wherein the contact holder is mounted within a receptacle housing to move in a direction that is orthogonal with respect to the direction of insertion of the plug into the receptacle, said receptacle housing including channels, in which the contact holder moves in said orthogonal direction, the connector further including bias means for maintaining the contact holder in a first position to receive the plug oriented in the first direction and to permit the contact holder to move to a second position to receive the plug oriented in the so direction.

4. The connector according to claim 3 wherein the contact holder includes channels in which the contacts are positioned to prevent shorting of the contacts.

5. The connector according to claim 3 further including a first insulator shield to cover one set of contacts as the receptacle engages the plug in the first orientation, and a second insulator shield to cover the other set of contacts as the receptacle engages the plug in the second orientation.

6. The connector according to claim 5 wherein the shield that is not in use to cover the contacts is movable by the plug during engagement to a retracted position.

7. A computer system including a central processing unit (CPU) and at least one peripheral device connected to the CPU by an 'A' type universal serial bus (USB) connector comprising a connector plug and a receptacle, wherein the connector includes an arrangement for bidirectional connection between the plug and the receptacle, and the USB connection utilizes an orientation sensor to detect the bidirectional orientation of the plug with respect to the receptacle.

8. The computer system according to claim 7 wherein the orientation sensor comprises a transducer that is mounted within the receptacle and is powered by the CPU.

9. The computer system according to claim 7 wherein the CPU includes a printed circuit board to electronically cross the pins over between the two sides of the connector, and vias to conduct the signal between the layers of the printed circuit board.

10. The computer according to claim 7 including channels in which the contact holder moves in the orthogonal direction in response to the orientation of the plug with respect to the receptacle.

11. A method for using an "A" type USB connector plug to engage a peripheral device with a receptacle of a host that is either a hub or a CPU, comprising:

(a) providing a contact holder having two rows of contacts within the receptacle;

(b) providing contact pins within the plug to engage one row of contacts in one orientation and to engage the second row of contacts in a second orientation;

(c) providing a bidirectional connector between the plug and the receptacle;

(d) engaging the plug with the receptacle;

(e) matching signals through the connector in accordance with established protocol for the USB connector regardless of orientation; and (f) positioning the contact holder in a first location to engage one row of contacts, and moving the contact holder in a direction that is orthogonal to the direction of engagement to engage the second row of contacts.

12. The method according to claim 11 including the step of shielding one row of contacts as the other row of contacts engages the plug.

13. The method according to claim 11 including the step of providing channels for each of the contacts to prevent short circuiting.

14. A method for using an "A" type USB connector plug to engage a peripheral device into a receptacle of a host that is either a hub or a CPU, comprising:

(a) using a bidirectional connector between the plug and the receptacle;

(b) engaging the plug with the receptacle;

(c) using an orientation sensor to sense the orientation of the plug with respect to the receptacle, and (d) matching signals through the connector in accordance with established protocol for the USB connector regardless of orientation.

15. The method according to claim 14 wherein the orientation sensor is a pressure transducer.

* * * * *